US009644558B2

(12) United States Patent
Dangelmaier et al.

(10) Patent No.: US 9,644,558 B2
(45) Date of Patent: May 9, 2017

(54) WORK APPARATUS AND METHOD FOR DETERMINING THE STARTING CONDITIONS THEREOF

(71) Applicant: Andreas Stihl AG & Co. KG, Waiblingen (DE)

(72) Inventors: Manuel Dangelmaier, Plochingen (DE); Tim Gegg, Remseck (DE); Clemens Klatt, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 294 days.

(21) Appl. No.: 14/597,891

(22) Filed: Jan. 15, 2015

(65) Prior Publication Data

US 2015/0198129 A1 Jul. 16, 2015

(30) Foreign Application Priority Data

Jan. 16, 2014 (DE) ..... 10 2014 000 467

(51) Int. Cl.
*F02D 41/06* (2006.01)
*F02B 63/02* (2006.01)
*F02D 41/20* (2006.01)

(52) U.S. Cl.
CPC ..... *F02D 41/062* (2013.01); *F02B 63/02* (2013.01); *F02D 41/064* (2013.01); *F02D 41/065* (2013.01); *F02D 2041/2065* (2013.01); *F02D 2200/022* (2013.01); *F02D 2200/0416* (2013.01); *F02D 2400/06* (2013.01)

(58) Field of Classification Search
CPC ..... F02N 11/08; F02D 41/062; F02D 41/064; F02D 41/065; F02D 2041/2065; F02D 2200/022; F02D 2400/06; F02B 63/02
See application file for complete search history.

(56) References Cited

U.S. PATENT DOCUMENTS

2006/0266020 A1* 11/2006 Okamoto ..... F02D 37/02 60/284

FOREIGN PATENT DOCUMENTS

DE 20 2011 000 519 U1 6/2012

* cited by examiner

*Primary Examiner* — Jacob Amick
(74) *Attorney, Agent, or Firm* — Walter Ottesen, P.A.

(57) ABSTRACT

A work apparatus has an internal combustion engine and a starter device for starting the engine. Within a housing of the work apparatus, a first electrical component is arranged at a first location and a second electrical component is arranged at a second location. A control unit is provided which is connected to the first electrical component and to the second electrical component. The control unit detects a first temperature-dependent value of the first electrical component at the first location, and a second temperature-dependent value of the second electrical component at the second location, and identifies the starting conditions as a function of these values. The first electrical component is a first actuator and the second electrical component is a second actuator or a sensor.

14 Claims, 4 Drawing Sheets

WORK APPARATUS AND METHOD FOR DETERMINING THE STARTING CONDITIONS THEREOF

CROSS REFERENCE TO RELATED APPLICATION

This application claims priority of German patent application no. 10 2014 000 467.8, filed Jan. 16, 2014, the entire content of which is incorporated herein by reference.

FIELD OF THE INVENTION

The invention relates to a work apparatus and to a method for determining the starting conditions of a work apparatus having an internal combustion engine, wherein a control unit, which is connected to a first electrical component and to a second electrical component, determines a first temperature-dependent measurement variable on the first electrical component and a second temperature-dependent measurement variable on the second electrical component. The control unit compares the first measurement variable with the second measurement variable and identifies the starting conditions.

BACKGROUND OF THE INVENTION

DE 20 2011 000 519 U1 discloses a work apparatus with an internal combustion engine in which a temperature sensor for detecting the temperature of the internal combustion engine is integrated into a component of the work apparatus. The output signals of the temperature sensors are evaluated in a control unit together with a temperature sensor for detecting the ambient temperature and the output signals are used to determine the starting conditions of the internal combustion engine. The temperature sensors which are used are additional components and require installation space; in addition they have to be cabled to the control unit.

SUMMARY OF THE INVENTION

It is an object of the invention to provide information to the control unit for defining the starting conditions of an internal combustion engine of a work apparatus without additional cabling and with simple means.

The control unit detects a first temperature-dependent value of a first electrical component and a second temperature-dependent value of a second electrical component, and defines, as a function of these values, the starting conditions, in particular the cold start conditions or warm start conditions, for starting an internal combustion engine with a starter device. The first component is a first actuator and the second component is a second actuator or a sensor. By using two electrical components and via the relative comparison of the temperatures which are tapped at the electrical components, it is possible to detect independently of the ambient temperature whether warm start conditions or cold start conditions are present.

In the case of an internal combustion engine which has been switched off for a sufficiently long time, the temperatures of the individual components, and also the temperatures of the electrical components which are evaluated by the control unit, become equal to the ambient temperature. On the other hand, while the internal combustion engine is operating, different temperatures occur within the housing of the work apparatus, and therefore also different temperatures occur at the electrical components. Since the components are actuators and/or sensors which usually have an electric coil, the resistance of the coil, in particular the ohmic resistance of the coil, also changes with the temperature. Therefore, the temperature of the electrical component can be determined indirectly on the basis of the altered electrical operating signals or via measurement pulses, without a specific temperature sensor being necessary. The signals which are detected by the control unit are evaluated by the control unit, and the starting conditions of the internal combustion engine are determined. It is therefore possible to dispense with installing additional temperature sensors which are used only to determine temperatures for defining starting conditions.

A first location at which a first electrical component is located is preferably thermally closer to the internal combustion engine than another, second location at which another, second electrical component is located. Given sufficiently long operation of the internal combustion engine, different temperatures occur within the housing. Locations which are thermally close to the internal combustion engine reach high temperatures. On the other hand, the locations which are thermally further away from the internal combustion engine reach lower temperatures in the same time period. As a result of the thermal distance between the first location and the second location, the temperature brought about by the internal combustion engine in a time period at the first location will have a different value than the temperature brought about by the internal combustion engine at the second location in the same time period. On the other hand, when an internal combustion engine has been switched off for a sufficiently long time, the ambient temperature is present everywhere in the housing, particularly also at the electrical components. As a result of a comparison between the temperature at the first location and the temperature at the second location, the control unit can detect the starting conditions. If the detected temperatures are the same, this is an indication of a cold start; and if the temperatures are different, this is an indication of a warm start.

It can also be advantageous if a component at the first location has a different decay behavior than a component at the second location. As a result of the different thermal decay behavior of the components at the two locations, the control unit can identify the operating state of the work apparatus and which starting conditions are present.

The housing is advantageously spatially partitioned into a first and a second housing region. The first electrical component is arranged in the first housing region and the second electrical component is arranged in the second housing region. The first housing region is preferably thermally separated from the second region. The spatial partitioning of the housing results in thermal separation into at least two housing regions in which the temperatures brought about by the internal combustion engine develop differently. The electrical components arranged in the housing regions assume the temperature in the respective housing region. The different temperatures brought about by the internal combustion engine in the different housing regions give rise to different temperature-dependent values in the electrical components. In addition, spatial partitioning into various housing regions is advantageous in order to protect the electrical components in different housing regions against excessively high temperatures, against contamination, against mechanical effects or the like.

In an embodiment of the invention, the sensor is arranged on the control unit. As a result, the sensor can output a temperature value to the control unit directly and without complicated cabling, in particular can even continuously supply a temperature value to the control unit while the work apparatus is operating.

The actuator is advantageously a component with an electrical coil, for example a solenoid valve, an ignition coil, a generator, an injection valve or the like. In addition to the actual function as an actuator during operation of the work apparatus, the control unit can receive from the actuator a temperature-dependent value which corresponds to a temperature of the actuator and which can be used to define the starting conditions. The temperature-dependent properties, actually undesired for the normal operation, of the components which are necessary to operate the work apparatus, such as the solenoid valve, ignition valve, generator, injection valve and the like are used according to the invention to determine the temperature on the basis of the temperature-dependent properties of these electrical components. The determined, temperature-dependent values are utilized by the control unit to determine what starting conditions are present.

The sensor is preferably a component such as a pressure sensor, a temperature sensor or the like. The main function of the sensor is to monitor the physical parameters, for example the pressure, temperature or the like, during the operation of the internal combustion engine. The physical parameter of a sensor is detected by the control unit during the operation of the work apparatus. In addition, the control unit can also acquire information from the sensor, which information serves to detect the temperature level, which can be used to define the starting conditions. The sensor, which is thus necessary in any case for the operation of the internal combustion engine, is given a double function. The sensor serves as information source for the control unit for defining the starting conditions during the starting of the internal combustion engine.

In a further embodiment, a third electrical component is arranged at a third location within the housing, wherein the third electrical component is an actuator. The measuring reliability is increased by three measuring points through the use of three electrical components. As a result, the starting conditions can be more reliably defined. Through the arrangement of the three electrical components at three locations within the housing, it is possible to reduce environmental influences, for example the radiation of the sun, which can falsify the measuring result.

For a method for determining the starting conditions of a work apparatus having an internal combustion engine, there is provision that a control unit, which is connected to a first electrical component and to a second electrical component, determines a first temperature-dependent measurement variable on the first electrical component and a second temperature-dependent measurement variable on the second electrical component. The control unit compares the first measurement variable with the second measurement variable and identifies the starting conditions. The control unit determines the first measurement variable on a first actuator and the second measurement variable on a second actuator or on a sensor. In one particular embodiment, the control unit converts the first measurement variable into a first conversion variable and the second measurement variable into a second conversion variable. For this purpose, a value table with a correlation between the comparison variable and the measurement variable can advantageously be used. In order to obtain intermediate values between two measurement variables stored in the table, the control unit can carry out an, in particular, linear interpolation. The first comparison variable can also be compared directly with the second comparison variable, in order to derive the present starting conditions from the comparison. In particular, the temperatures which are derived from the measurement variables are suitable as comparison variables.

The measurement variables are advantageously determined during the starting process of the work apparatus. During the starting process, electrical energy for operating the electrical components is generated, with the result that the components can be actuated by the control unit. The temperature is advantageously indirectly determined from the temperature-dependent operating variables of the electrical components by the control unit, with the result that, after a comparison of the temperatures, a statement can be made about the starting conditions. The temperature-dependent measurement variable is advantageously correlated with the temperature-dependent value of the electrical component. The starting conditions are preferably identified before the starting of the internal combustion engine and evaluated. As a result, the identified starting conditions can be used to make settings at the internal combustion engine which are suitable for the start. The temperature-dependent measurement variable is preferably measured at the actuator before the actuator is put into operation. As a result, possible influences on the measurement variable as a result of the operation of the actuator are avoided.

The actuator for determining the temperature-dependent measurement variable is preferably provided with a measurement current, wherein in order to determine the measurement variable a lower current is used than the minimum necessary current to operate the actuator. As a result, the actuator is not put into operation when the measurement variable is determined, but instead merely serves as a measurement pickup or as sensor at that moment. As a result, the temperature-dependent measurement variable can be determined without, for example, the actuator switching.

The control unit advantageously determines a temperature-dependent resistance, in particular an internal resistance or an ohmic resistance, at a coil arranged in the actuator. As a result of the use of temperature-sensitive electrical components such as for example a coil, a temperature-dependent measurement variable can be determined precisely within a measurement tolerance. As a result, the starting conditions can be predicted accurately. It can also be advantageous to evaluate a temperature-dependent measurement variable in a circuit arranged in the actuator.

In a further embodiment, the control unit at least partially records the change over time in a magnetic field of a coil arranged in the actuator and forms the measurement variable therefrom. As a result of the utilization of a non-steady-state, temperature-dependent behavior of the coil arranged in the actuator, it is possible to draw conclusions about the temperature of the actuator. For example, the time profile of the buildup or of the reduction in the magnetic field, which proceeds, in particular, as a function of temperature, can be read out by the control unit. The control unit identifies the starting conditions on the basis of the information on the temperature of the actuator which is, for example, derived as described above.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
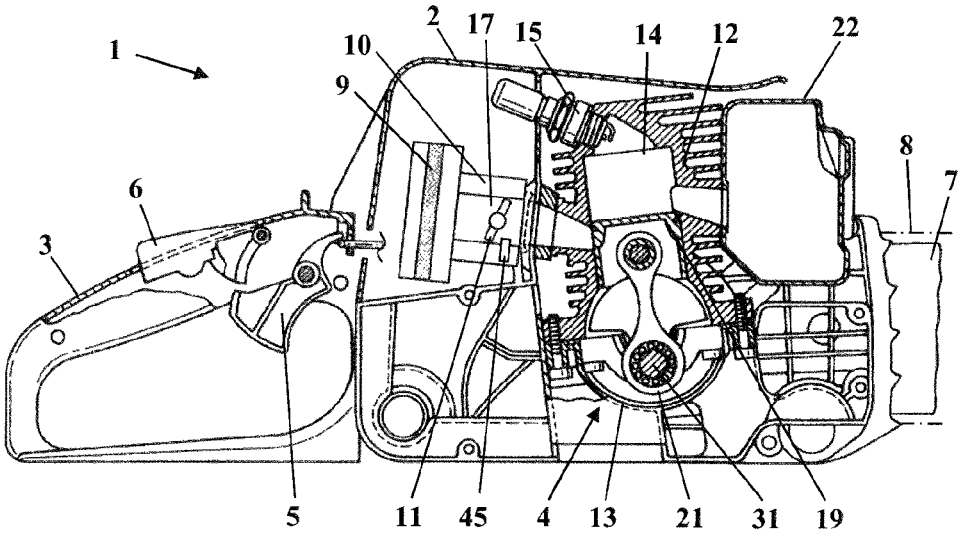
FIG. 1 is a schematic section through a power saw having an internal combustion engine.

FIG. 1 shows, as an embodiment, a power saw 1 which is driven by an internal combustion engine 4. The invention can also be used in other work apparatuses having an internal combustion engine 4, for example in a brush cutter, cutoff machine, lawnmower, chopper, harvesting device, suction/blowing device, in a hedge cutter or the like. In the embodiment, the internal combustion engine 4 is embodied as a two-stroke engine. The internal combustion engine 4 can also be a four-stroke engine.

The power saw 1 includes a housing 2 which accommodates the internal combustion engine 4. A handle 3 is attached to the housing 2. A throttle lever 5 and a throttle lever lock 6 are pivotably mounted on the handle 3. The rotation speed of the internal combustion engine 4 can be controlled with the throttle lever 5.

A guide bar 7 is arranged on the side of the housing 2 opposite the handle 3. A saw chain 8 runs as a tool on the guide bar 7 and is driven by the internal combustion engine 4 via a drive sprocket 30 (FIG. 3) which is not shown.

The internal combustion engine 4 has a cylinder 12 and a crankcase 13 in which a crankshaft 31 is rotatably mounted. The crankshaft 31 is driven by a piston 19 via a connecting rod 21. The piston 19 delimits a combustion chamber 14 in the cylinder 12. For an operation, the internal combustion engine 4 draws in combustion air. The combustion air flows through an air filter 9 into an intake channel 17, the opening of which is controlled by the piston 19. The intake channel 17 has a carburetor 10. In the carburetor 10, fuel is added to the combustion air, controlled by a partially electrically regulated fuel system 45, as a result of which a fuel/air mixture which is capable of igniting is produced in the combustion chamber 14. In order to control the flow of the combustion air, the carburetor 10 has a pivotable throttle element 11. The throttle lever 5 of the work apparatus acts on the throttle element 11. The position of the throttle element 11 is influenced and controlled by the position of the throttle lever 5. Depending on the operating state, for example full load operation, partial load-operation, idling operation, starting process, the throttle element 11 assumes a different position.

The combustion air is enriched with fuel via the intake channel 17 and via the carburetor 10 to form an ignitable fuel/air mixture. This combustion air flows firstly into the crankcase 13 and subsequently via transfer channels (not illustrated in more detail) into the combustion chamber 14. A spark plug 15, arranged on the cylinder 12, projects at least partially into the combustion chamber 14. The spark plug 15 ignites the fuel/air mixture in the combustion chamber 14. The exhaust gases produced by the combustion flow into the open air via an exhaust muffler 22.

Figure 2:
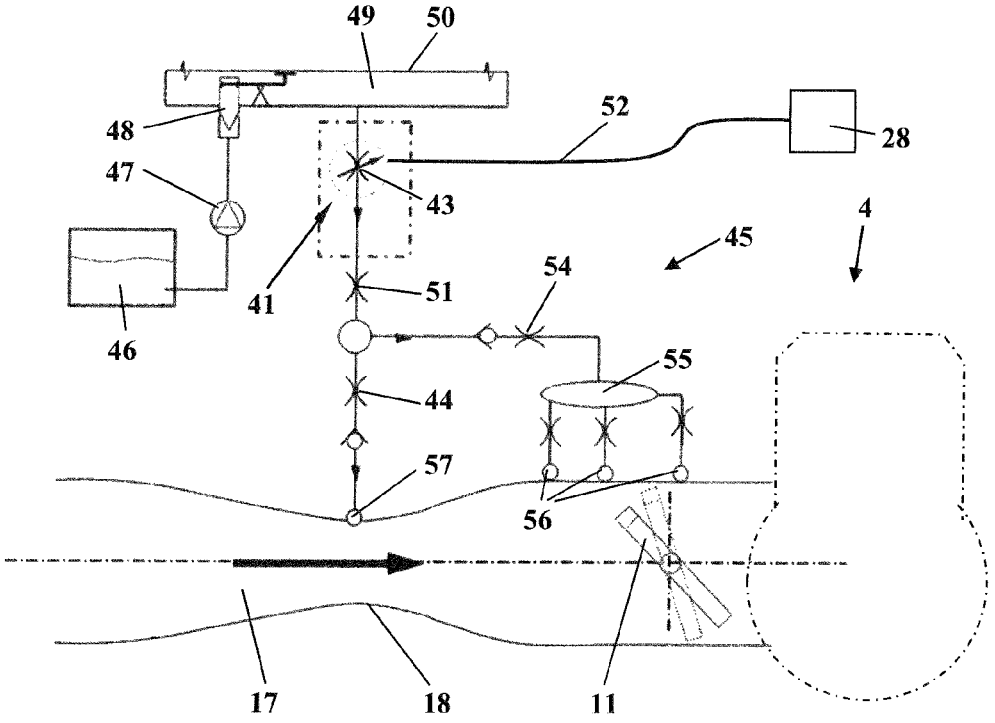
FIG. 2 is a schematic of a fuel system for an internal combustion engine.

FIG. 2 is a schematic of the fuel system 45 for forming the fuel/air mixture in the intake channel 17. A venturi 18 is formed in the intake channel 17. In the venturi, the combustion air is accelerated and a partial vacuum is produced, in particular at the narrowest cross section of the venturi 18. Through this partial vacuum, fuel is drawn in via a main nozzle path 44 of the fuel system 45. The fuel is fed into the intake channel 17 via a main nozzle 57 which is arranged in the region of the narrowest cross section of the venturi 18.

The fuel is firstly fed from a fuel tank 46 into a regulating chamber 49 via a fuel prefeed pump 47 and a pressure-controlled regulating valve 48. A regulating diaphragm 50 partitions the regulating chamber 49 from a compensator. In the compensator, approximately the same static pressure as the static pressure is present in the intake channel 17 outside the venturi 18, in particular downstream of the air filter 9. The pressure-controlled regulating valve 48 opens as soon as the regulating diaphragm 50 moves in the direction of the regulating chamber 49 because of the flowing of fuel out of the regulating chamber 49.

The fuel flow in a fuel duct 51, which leads away from the regulating chamber 49, can be set by an electrically controllable fuel valve 43. The electrically controllable fuel valve 43 is electrically actuated by a control unit 28 via a valve cable 52.

The fuel duct 51 branches downstream of the fuel valve 43 into the main nozzle path 44 and into an idling path 54. The idling path 54 feeds fuel into the intake channel 17 via an idling chamber 55 and a plurality of idling nozzles 56 which open into the intake channel 17 in the pivoting region of the throttle element 11. Consequently, fuel can be mixed into the combustion air both via the main nozzle 57 and via the idling nozzles 56. The feeding of the fuel is determined by the intake partial vacuum in the venturi 18 and by the opening position of the electrical fuel valve 43.

When the internal combustion engine 4 starts, the fuel/air mixture is set in a different ratio as a function of the starting conditions, specifically whether cold start conditions or warm start conditions are present. In the case of cold start conditions, the control unit 28 sets, in contrast to warm start conditions, a rich fuel/air mixture. For this purpose, the control unit 28 regulates, via the electric fuel valve 43, the quantity of fuel flowing into the intake channel 17 of the carburetor 10. The control unit 28 determines, for example, the time of opening and closing of the fuel valve 43 and the duration of the open or closed fuel valve 43. As a result, via the fuel valve 43, it is possible to set the degree of leanness or richness of the fuel/air mixture which is fed to the combustion chamber 14.

If the internal combustion engine 4 is to be started, it is firstly to be checked whether cold start conditions or warm start conditions are present. There are warm start conditions if the temperature of the internal combustion engine 4 exceeds a specific limit temperature. This limit temperature is typically above the ambient temperature. There are warm start conditions if the internal combustion engine 4 was already operational at least for a certain time before the start and therefore the temperature of the internal combustion engine 4 is raised. If the temperature of the internal combustion engine 4 is below the limit temperature, cold start conditions are present.

According to the invention, before the start (that is, during pull rope starting and in advance of the first ignition spark), and in the starting process, the temperature of the internal combustion engine 4 is detected and transmitted to the control unit 28. On the basis of FIG. 3, it is to be explained how electrical energy is generated before the start and in the starting process and how the control unit 28 can behave during the start and the starting process.

Figure 3:
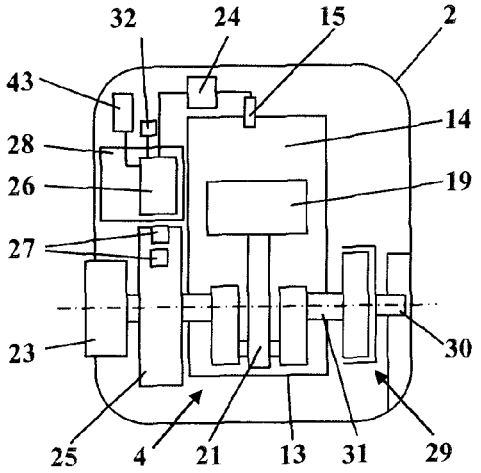
FIG. 3 is a schematic of an internal combustion engine with components used to start the internal combustion engine.

In FIG. 3, an operationally capable internal combustion engine 4 is schematically shown. A starter device 23, which is of mechanical or electrical configuration, is arranged on the crankshaft 31. The crankshaft 31 is rotated with the starter device 23 and the following are moved: a flywheel 25, which is mounted on the crankshaft 31, a connecting rod 21 with the piston 19; and, a first part of a centrifugal force coupling 29. The flywheel 25 is fitted with magnets 27 which induce a voltage at an ignition module 26 when the flywheel 25 rotates. The ignition module 26 is electrically connected to the control unit 28 and to further electrical components such as actuators and sensors and supplies these with electrical energy. The following are referred to as actuators or sensors: the spark plug 15, a coil, such as for example an ignition coil 24 or similar electrical components, which are connected to the spark plug 15.

The control unit 28 controls various functions which are necessary for the operation of the work apparatus. The control unit 28 decides, before the start and during the starting process, whether warm start conditions or cold start conditions are present. For this reason, the control unit 28 is electrically connected to the actuators and sensors. As soon as electrical energy is available, the control unit 28 can not only actuate the electric fuel valve 43 during the starting process but can, for example, also influence the timing of the ignition spark of the spark plug 15 and therefore take the measures which are necessary for a warm start or for a cold start. For this purpose, however, the control unit must know whether there are cold start conditions or warm start conditions. Hereinafter, it is explained how the control unit determines the starting conditions in the embodiment.

Figure 4:
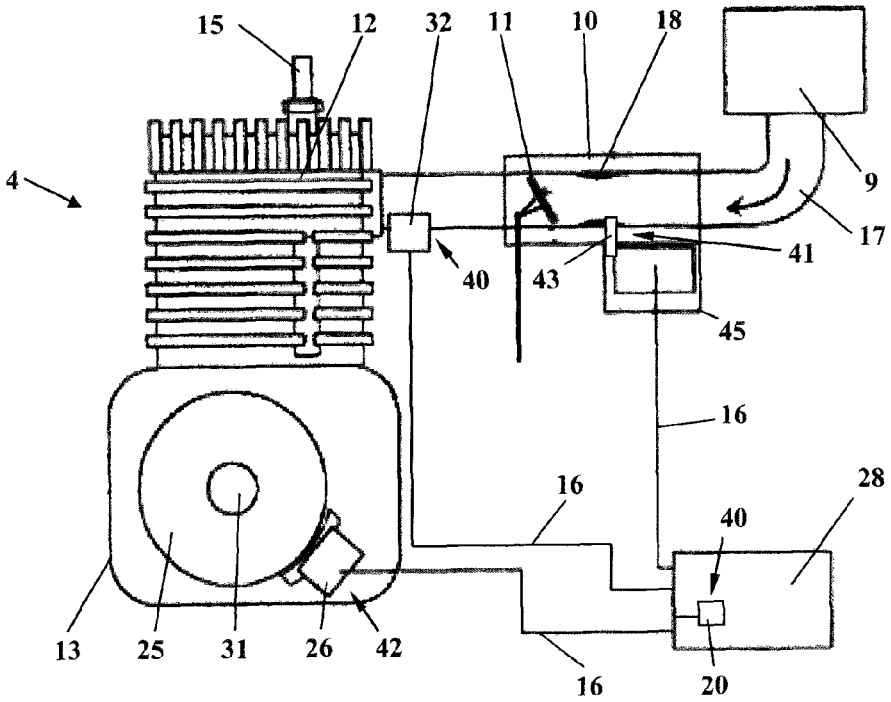
FIGS. 4 and 5 are schematics of the arrangement of electrical components on an internal combustion engine.

FIG. 4 shows a schematic arrangement of the electrical components in the work apparatus. The control unit 28, which is supplied with electrical energy from the ignition module 26, is connected to the electrical components by a cable 16. The electrical components include actuators (41, 42), for example, the electric fuel valve 43 as a first actuator 41, or the ignition module 26 as a second actuator 42, and sensors 40, for example a pressure sensor 32 or a temperature sensor 20. In their basic function, the actuators (41, 42) react to commands of the control unit 28. The sensors 40 supply information to the control unit 28, for example measured values or measurement variables.

In the present embodiment, the control unit 28 can also actuate the actuators (41, 42) in such a way that the actuators (41, 42) supply information, for example values such as measured values or measurement variables. The actuators operate in this case as sensors 40 and therefore have a double function. The sensors 40 have a double functionality since the sensors 40 carry out a different function during operation than during the starting process in which the sensors 40 are used to determine the starting conditions.

The actuators (41, 42) are provided here with a measurement current which is determined by the control unit 28. The current is typically considerably lower, for example, an order of magnitude lower, than the current necessary to operate the actuator (41, 42). Depending on the temperature of the actuator (41, 42), the coil thereof will have a certain resistance which brings about a voltage drop. The voltage drop is detected by the control unit 28 and corresponds, as a measured value or to the measurement variable of a specific temperature. This temperature-dependent value of the actuator (41, 42) permits a statement to be made as to which state the actuator is in, in particular how warm the actuator (41, 42) is. By comparing the temperature-related measurement variables of at least two electrical components, that is, either via two actuators (41, 42) or via an actuator (41, 42) and a sensor 40, the control unit 28 detects what starting conditions are present. In this context, a relative comparison of the measurement variables is sufficient, without the need for the absolute temperature to be determined.

If the control unit 28 determines that the temperatures at the two measured components are approximately of equal magnitude, this is thus an indication that cold start conditions are present. If the control unit 28 determines that the temperatures at the two measured components differ from one another, this is therefore an indication that warm start conditions are present.

Since the different temperatures of the two measured components are to be evaluated as an indication for the starting conditions, it is necessary to ensure that the two components have different temperatures during the operation of the work apparatus. This is achieved by selecting the locations at which the electrical components are arranged in the work apparatus. Electrical components which are located close to the internal combustion engine 4, which is hot during operation, heat up to a higher temperature than electrical components which are located further away from the hot internal combustion engine 4 and therefore heat up less during the same period of time, that is, are colder. In the text which follows, the location at which electrical components which can be used for the determination for the starting conditions by the control unit can be arranged will be indicated for an embodiment.

The pressure sensor 32 is arranged on the intake channel 17; in the embodiment, the pressure sensor 32 is mounted near to the cylinder. A further pressure sensor can be arranged in the crankcase 13. The temperature at the pressure sensor 32 is relatively high due to the proximity to the internal combustion engine 4.

The electric fuel valve 43 is arranged at the carburetor 10. During operation, the temperature at the carburetor 10 is also significantly below the temperature at the internal combustion engine 4 itself.

The ignition module 26 is mounted on the flywheel 25, for example on the fan wheel. The temperature at the ignition module 26 should accordingly be below the temperature at the internal combustion engine 4 during operation. It is to be noted that the ignition module 26 can heat up due to intrinsic heat during operation, as a result of which the temperature at the ignition module 26 is influenced not only by the location in the work apparatus but also by the intrinsic operating temperature. This can also be used to determine the starting conditions.

In the embodiment, a temperature sensor 20 is arranged in the control unit 28. The control unit 28 can be installed near to the ignition module 26, for example on the circuit board thereof or can be at a distance from the ignition module 26, as in the embodiment. During the operation of the internal combustion engine 4, the temperature sensor 20 measures the temperature of the control unit 28. In the case of electronic components such as the control unit 28 it is also necessary to ensure that the temperature of the control unit 28 comes about not only as a result of the internal combustion engine 4 but also as a result of the intrinsic heat produced during operation. The temperature sensor 20 can also be arranged at another location, for example at the cylinder 12, at the carburetor 10, at the crankcase 13, on the outside of the housing 2 or the like.

Figure 5:
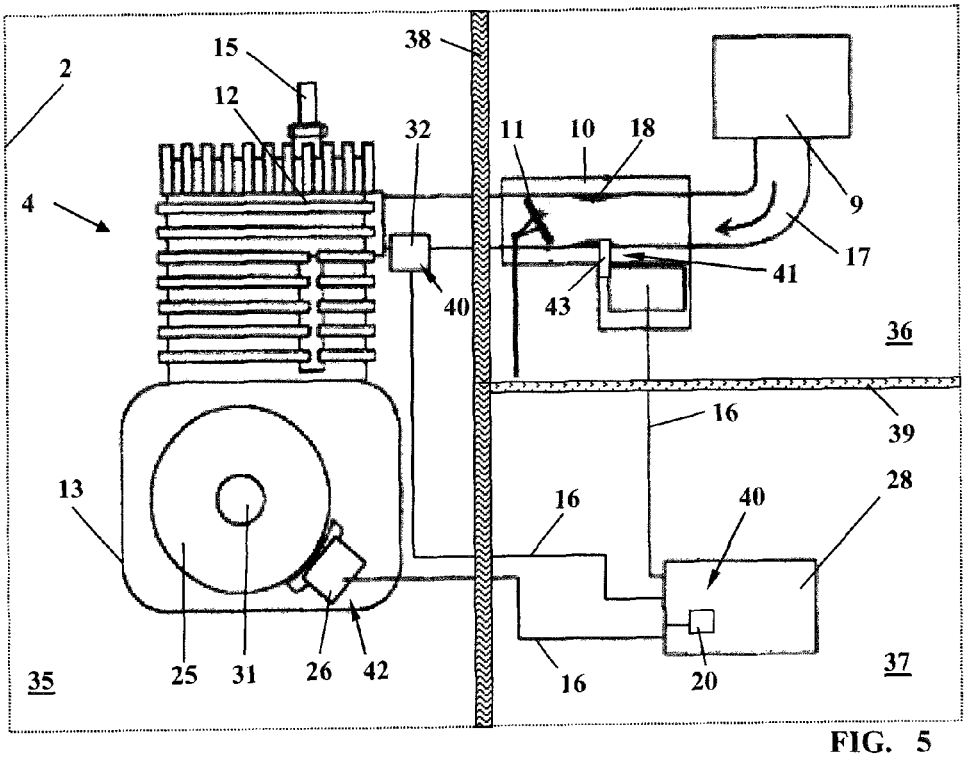

FIG. 5 shows, in a way similar to FIG. 4, the arrangement of the electrical components. In addition, FIG. 5 illustrates that the electrical components can be arranged in various housing regions (35, 36, 37) within the housing 2. In the embodiment, a first housing region 35 is thermally influenced directly by the cylinder 12. During the operation of the internal combustion engine 4, it can be assumed that the first housing region 35 is strongly heated by the cylinder 12 and is therefore hot. The first housing region 35 is thermally isolated from a second housing region 36 and from a third housing region 37 via an insulator 38. The carburetor 10 is arranged in the second housing region 36. The insulator 38 can be manufactured from an epoxy resin which has an insulating effect. During operation of the internal combustion engine 4, the temperature of the carburetor 10 in the second housing region 36 is significantly below the temperature of the cylinder 12. The temperature of the second housing region 36 is significantly lower during the operation of the internal combustion engine 4 than the temperature of the first housing region 35 as a result of the insulator 38. During operation of the internal combustion engine 4, the temperature in the second housing region 36 is only slightly above the ambient temperature. The second housing region 36 should accordingly be considered to be cold.

The control unit 28 is arranged in the third housing region 37. The second housing region 36 can be structurally separated from the third housing region 37 by a heat conductor 39, for example by an aluminum plate. The temperature in the third housing region 37 is such that the functional capability of the control unit 28 is not adversely affected. The temperature in the third housing region 37 is typically also only slightly above the ambient temperature during the operation of the internal combustion engine 4. The third housing region 37 should also be considered to be cold.

In addition to the absolute temperature differences between the housing regions (35, 36, 37) during the operation of the internal combustion engine 4, the thermal decay behavior after the shutting down of a hot internal combustion engine 4 can also be different in the housing regions (35, 36, 37). The thermal decay behavior is, on the one hand, influenced by the insulator 38. On the other hand, the thermal decay behavior is influenced by the spatial distance of the electrical components from the internal combustion engine 4. Conclusions can be drawn about the starting conditions not only from the temperature at the electrical components but also from the thermal decay behavior of the electrical components. This is explained below.

Figure 6:
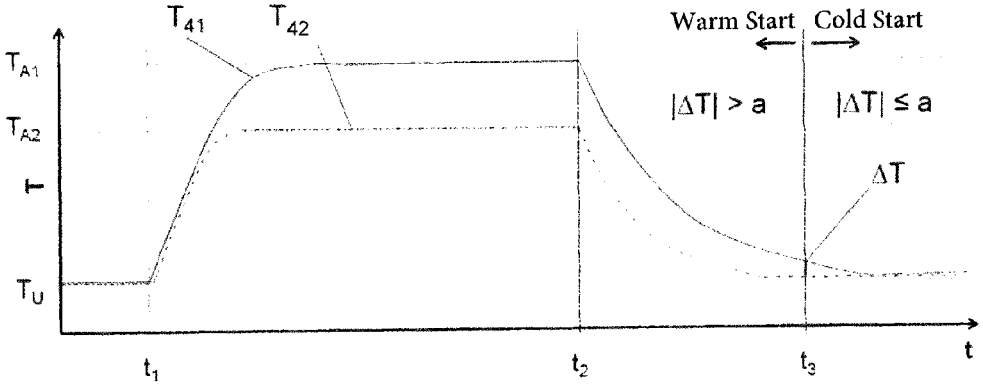
FIG. 6 is a diagram showing the schematic temperature profile of two electrical components with the same thermal decay behavior; and, FIG. 7 is a diagram showing the schematic temperature profile of two electrical components with different thermal decay behaviors.
Figure 7:
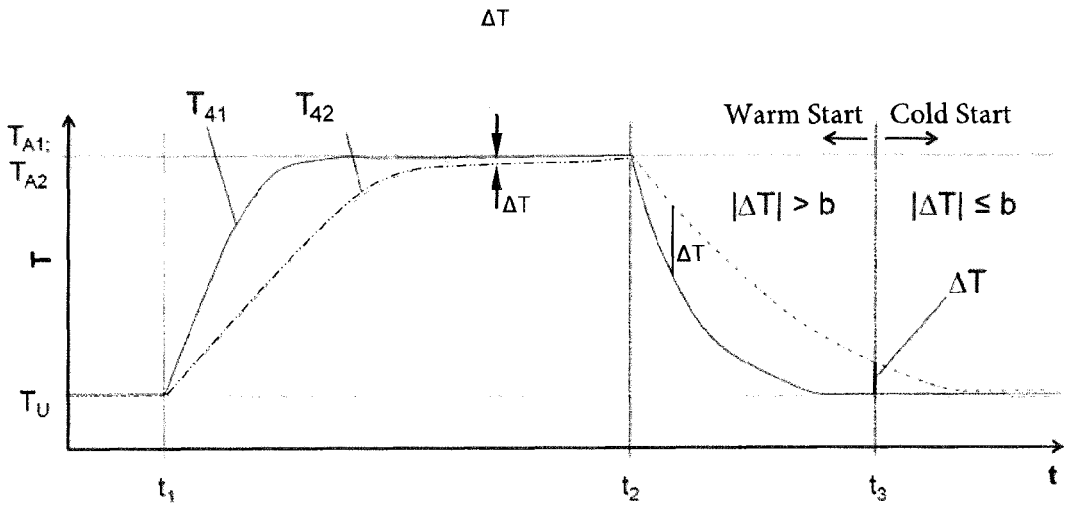

FIGS. 6 and 7 are each schematic views showing a possible temperature profile at different locations of the work apparatus under different operating conditions. In FIG. 6, the thermal decay behavior at the evaluated locations is identical, but the absolute temperatures during the operation of the internal combustion engine 4 are different.

The time profile with the continuing time (t) is plotted on the (x) axis. At the starting time $t_1$, the internal combustion engine 4 is started. At the stopping time $t_2$, the internal combustion engine 4 is switched off. The measuring time $t_3$ gives the time of a possible restarting of the internal combustion engine 4. The temperature T is plotted on the (y) axis. $T_U$ gives the ambient temperature. A maximum temperature $T_{A1}$ of the first actuator 41 gives the temperature of the first actuator 41 which can be reached asymptotically and which can be reached at the first actuator 41 given sufficiently long operation of the internal combustion engine 4. A maximum temperature $T_{A2}$ of the second actuator 42 gives the temperature of the second actuator 42 or of the sensor 40 which can be reached given a sufficiently long operation period of the internal combustion engine 4. The function with the continuous line gives a temperature $T_{41}$ at the first actuator 41 as a function of the time (t). The function which is represented with a dashed line gives a temperature $T_{42}$ at the second actuator 42 or at the sensor 40 as a function of the time (t).

Before the starting time $t_1$ of the engine start, the temperature $T_{41}$ of the first actuator 41 and the temperature $T_{42}$ of the second actuator 42 are identical to the ambient temperature $T_U$. After the engine start, the temperature $T_{41}$ of the first actuator 41 and the temperature $T_{42}$ of the second actuator 42 rise. Given a sufficiently long operating period of the internal combustion engine 4, the temperature $T_{41}$ of the first actuator 41 approaches the maximum temperature $T_{A1}$ of the first actuator 41 asymptotically. Likewise, the temperature $T_{42}$ of the second actuator 42 approaches the maximum temperature $T_{A2}$ of the second actuator 42 asymptotically. In this example, the maximum temperature $T_{A1}$ of the first actuator 41 is higher than the maximum temperature $T_{A2}$ of the second actuator 42; the temperature $T_{41}$ of the first actuator 41 is correspondingly higher than the temperature $T_{42}$ of the second actuator 42 given a sufficiently long operating period of the internal combustion engine 4.

At the stopping time $t_2$, the internal combustion engine 4 is shut down. Both the temperature $T_{41}$ of the first actuator 41 and the temperature $T_{42}$ of the second actuator 42 drop. The difference in temperature $\Delta T$, which corresponds to the temperature difference of the temperature $T_{41}$ of the first actuator 41 minus the temperature $T_{42}$ of the second actuator 42, $\Delta T = T_{41} - T_{42}$ is lower when the temperature $T_{41}$ of the first actuator 41 and the temperature $T_{42}$ of the second actuator 42 become cooler.

At the measuring time $t_3$ of a possible restart of the internal combustion engine 4, the control unit reads out the temperature $T_{41}$ of the first actuator 41 and the temperature $T_{42}$ of the second actuator 42, forms the temperature difference $\Delta T$ and decides whether the absolute value $|\Delta T|$ of the temperature difference is greater than a freely selectable parameter (a), which is stored in the control unit 28, or whether the absolute value $|\Delta T|$ of the temperature difference is less than or equal to the selected parameter (a). If the absolute value $|\Delta T|$ of the temperature difference is greater than the parameter (a), warm start conditions are present. If the absolute value $|\Delta T|$ of the temperature difference is less than or equal to the parameter (a), cold start conditions are present. The parameter (a) can directly be a predefined limiting value temperature; alternatively it is also possible to predefine, for example, a limiting value for the ohmic resistance of the component as the parameter (a), with the result that the control unit does not evaluate the temperature itself but instead merely the values of the ohmic resistance, for example of the actuators (41, 42), which change with the temperature. Any variable of an actuator or sensor which changes as a function of temperature can be evaluated in the control unit 28; a change in magnitude of the monitored variable, which results owing to the temperature, is then merely evaluated in the control unit 28 without the temperature itself having to be determined. The parameter (a) is selected in accordance with the variable which is to be evaluated. The monitored variable may be, for example, the ohmic resistance of a coil, the current flowing through a coil when the measurement voltage is the same, the voltage dropping across the coil when the measuring current is the same, a change in the inductance or capacitance of an actuator or sensor or corresponding, temperature-dependent variables.

In the diagram in FIG. 6, the internal combustion engine 4 is not started again at the measuring time $t_3$. Given a sufficiently long dwell time without a restart of the internal combustion engine 4, the temperature $T_{41}$ of the first actuator 41 and the temperature $T_{42}$ of the second actuator 42 approach the ambient temperature $T_U$ asymptotically.

FIG. 7 shows a further embodiment with a temperature profile at various locations in the work apparatus with different thermal decay behavior. In turn, the time (t) is plotted on the (x) axis, wherein the engine is started at the starting time $t_1$, the engine is shut down at the stopping time $t_2$, and a measurement takes place at the measuring time $t_3$ to determine whether warm start conditions or cold start conditions are present.

In turn, the temperature T is plotted on the (y) axis, with $T_U$ of the ambient temperature. The maximum temperature $T_{A1}$ of the first actuator 41 and the maximum temperature $T_{A2}$ of the second actuator 42 correspond to the temperatures which can be reached asymptotically at the two locations given a sufficiently long operating period of the internal combustion engine 4. The continuous line corresponds to the temperature profile of the temperature $T_{41}$ of the first actuator 41 as a function of the time. The dashed line corresponds to the temperature profile of the temperature $T_{42}$ of the second actuator 42 or of the sensor 40 as a function of the time (t).

Before the starting time $t_1$ of the engine start, the ambient temperature $T_U$ is present at the first actuator 41 and at the second actuator 42 or sensor 40. Accordingly, the temperature $T_{41}$ of the first actuator 41 is identical to the ambient temperature $T_U$, and the temperature $T_{42}$ of the second actuator is identical to the ambient temperature $T_u$. After the starting time $t_1$ of the internal combustion engine 4, the temperature $T_{41}$ of the first actuator 41 and the temperature $T_{42}$ of the second actuator 42 rise. Owing to the different thermal decay behavior, the temperature $T_{41}$ of the first actuator 41 rises more strongly than the temperature $T_{42}$ of the second actuator 42. The gradient of the change in temperature as a function of the time (t) of the temperature $T_{41}$ of the first actuator 41 is greater than the gradient of the change in temperature as a function of the time (t) of the temperature $T_{42}$ of the second actuator 42.

After a sufficiently long operating period of the internal combustion engine 4, both the temperature $T_{41}$ of the first actuator 41 and the temperature $T_{42}$ of the second actuator 42 approach the asymptotic limiting value of the maximum temperature $T_{A1}$ of the first actuator 41 or of the maximum temperature of the second actuator $T_{A2}$; the following applies: $T_{A1}=T_{A2}$. The maximum temperature at the time $t_2$ is approximately 120° C. Owing to the different thermal decay behavior, the temperature $T_{41}$ of the first actuator 41 reaches the asymptotic limiting value of the maximum temperature $T_{A1}$ of the first actuator 41 more quickly than the temperature $T_{42}$ of the second actuator 42 reaches the asymptotic limiting value of the maximum temperature $T_{A2}$ of the second actuator 42.

At the stopping time $t_2$ of the engine stop, both the temperature $T_{41}$ of the first actuator 41 and the temperature $T_{42}$ of the second actuator 42 drop. Owing to the different thermal decay behavior, the gradient of the temperature as a function of the time (t) of the temperature $T_{42}$ of the second actuator 42 is lower than the gradient of the temperature as a function of the time (t) of the temperature $T_{41}$ of the first actuator 41.

In the embodiment, at the measuring time $t_3$ the temperature difference ΔT between the temperature $T_{41}$ of the first actuator 41 and the temperature $T_{42}$ of the second actuator 42, $\Delta T=T_{41}-T_{42}$ is measured. The control unit 28 forms the absolute value of the temperature difference ΔT and determines whether this |ΔT| is higher than a freely selectable parameter (b) or whether |ΔT| is less than or equal to the selected parameter (b). If the absolute value |ΔT| of the temperature difference is higher than the parameter (b), warm start conditions are present. If the absolute value |ΔT| of the temperature difference is less than or equal to the parameter (b), cold start conditions are present. It is essential here that the control unit 28 considers the time difference between the measuring time and the engine stop time $t_3-t_2$ during the evaluation of the temperature difference ΔT. Alternatively, at the measuring time $t_3$, the control unit 28 can also evaluate the gradient of the temperature as a function of the time (t) at the measuring time $t_3$ of the temperature of the second actuator $T_{42}$ and of the temperature of the first actuator $T_{41}$ and compare them with one another. If the absolute value of the difference between the gradients of the temperature $T_{42}$ of the second actuator 42 and the temperature $T_{41}$ of the first actuator 41 is greater than a freely selectable parameter which is also stored in the control unit 28, warm start conditions are present; if the absolute value is less than or equal to the parameter, cold start conditions are present.

In the diagram in FIG. 7, the internal combustion engine 4 is not started again at the measuring time $t_3$. Both the temperature $T_{42}$ of the second actuator 42 and the temperature $T_{41}$ of the first actuator 41 approach the ambient temperature $T_U$ with a sufficiently long waiting time.

FIGS. 6 and 7 illustrate idealized, that is, schematic, working conditions of the electrical components. In reality, a mixed form of the temperature behavior of the electrical components from FIGS. 6 and 7 should be assumed; the components will accordingly have both different absolute operating temperatures as well as a different thermal decay behavior.

The control unit 28 can also firstly calibrate the measurement variables, in particular set them to zero, before the measuring of the temperatures of the electrical components. After calibration, the control unit can measure the temperatures of the electrical components with the calibrated measurement variables.

The parameters (b) and (c) can also be directly a predefined temperature which represents a limiting value; alternatively it is also possible to predefine a, for example, limiting value as the ohmic resistance of the component as the parameter (b) or (c) with the result that the control unit does not evaluate the temperature itself but rather merely the values of the ohmic resistances, for example of the actuators (41, 42), which change with the temperature. In the control unit 28 it is possible to evaluate any variable of an actuator or sensor which changes as a function of the temperature; in the control unit 28, merely a change in magnitude of the monitored variable, which occurs as a result of the temperature, is then evaluated, without the temperature having to be determined itself. According to the variable to be evaluated, the parameter (b) or (c) is selected. The monitored variable can be, for example, the ohmic resistance of a coil, the current flowing through a coil when the measurement voltage is the same, the voltage dropping across the coil when the measurement current is the same, a change in the inductance or capacitance of an actuator or sensor or corresponding, temperature-dependent variables.

It is understood that the foregoing description is that of the preferred embodiments of the invention and that various changes and modifications may be made thereto without departing from the spirit and scope of the invention as defined in the appended claims.

What is claimed is:

1. A work apparatus comprising:

an internal combustion engine;

a starter device for starting said internal combustion engine;

a housing;

a first electrical component arranged at a first location in said housing and configured as a first actuator;

a second electrical component arranged at a second location in said housing and configured as a second actuator or a sensor;

a control unit connected to said first electrical component and said second electrical component;

said control unit being configured to detect a first temperature dependent value of said first electrical component and a second temperature dependent value of said second electrical component; and, said control unit being further configured to determine starting conditions on the basis of said first and said second temperature dependent values.

2. The work apparatus of claim 1, wherein said first location is thermally closer to said combustion engine than said second location.

3. The work apparatus of claim 1, wherein a different thermal decay behavior is present at said first location than at said second location.

4. The work apparatus of claim 1, wherein:

said housing is spatially partitioned into a first housing region and a second housing region;

said first electrical component is arranged in said first housing region; and, said second electrical component is arranged in said second housing region.

5. The work apparatus of claim 4, wherein said first housing region is thermally separated from said second housing region.

6. The work apparatus of claim 1, wherein said second electrical component is a sensor arranged on said control unit.

7. The work apparatus of claim 1, wherein said first or said second actuator is one of a magnetic valve, an ignition coil, a generator and an injection valve.

8. The work apparatus of claim 1, wherein said second electrical component is configured as one of a pressure sensor and a temperature sensor.

9. The work apparatus of claim 1 further comprising a third electrical component configured as an actuator and arranged at a third location in said housing.

10. A method of determining the start conditions of a work apparatus including an internal combustion engine; a control unit; a first electrical component connected to the control unit; and, a second electrical component connected to the control unit, the method comprising the steps of:

determining, via the control unit, a first temperature dependent measurement value at the first electrical component configured as a first actuator;

determining, via the control unit, a second temperature dependent measurement value at the second electrical component configured as a second actuator or a sensor;

comparing said first temperature dependent measurement value to said second temperature dependent measurement value via the control unit; and, determining the start conditions with the control unit on the basis of the comparison of said first and second temperature dependent values.

11. The method of claim 10, wherein said determining of the first temperature dependent measurement value and said determining of the second temperature dependent measurement value is performed during the start procedure of the work apparatus.

12. The method of claim 10, comprising the further step of supplying respective currents to said actuators which are less than needed to operate said actuators in order to determine the measurement values.

13. The method of claim 10, wherein a coil is arranged on one of said actuators; and, said control unit is configured to detect a temperature-dependent resistance on said coil.

14. The method of claim 10, wherein a coil is arranged on one of said actuators with the coil generating a magnetic field and the control unit is configured to record, at least partially, the time-dependent change of said magnetic field to form the measurement value corresponding to the actuator having said coil arranged thereon.

* * * * *